US005557053A

United States Patent [19]

Nickel

[11] Patent Number: 5,557,053

[45] Date of Patent: Sep. 17, 1996

[54] SNARE STRAINER FOR A DRUM

[76] Inventor: Gregory L. Nickel, 3206 William Avenue, North Vancouver, B.C., Canada, V7K 2Y1

[21] Appl. No.: 424,805

[22] Filed: Apr. 19, 1995

[51] Int. Cl.[6] ..... G10D 13/02

[52] U.S. Cl. ..... 84/415

[58] Field of Search ..... 84/415, 416, 417

[56] References Cited

U.S. PATENT DOCUMENTS

| | | | |
|---|---|---|---|
| 1,104,373 | 7/1914 | Meyer | 84/415 |
| 2,024,937 | 2/1933 | Ludwig | 84/415 |
| 2,096,209 | 6/1934 | Strupe | 84/415 |
| 2,621,554 | 9/1950 | Way | 84/415 |
| 3,865,003 | 2/1975 | Della-Porta | 84/415 |
| 3,981,220 | 9/1976 | Clark | 84/415 |
| 4,339,982 | 7/1982 | Hoshino | 84/415 |
| 5,107,742 | 4/1992 | Cummings et al. | 84/415 |
| 5,353,674 | 10/1994 | Volpp | 84/415 |

*Primary Examiner*—Cassandra C. Spyrou
*Attorney, Agent, or Firm*—Dorn, McEachran, Jambor & Keating

[57] ABSTRACT

A snare strainer for a drum. The snare strainer includes a cylindrical tube which is mounted on the shell of a drum. A piston is installed in the cylindrical tube for slidable movement between a first position in which the snares are positioned against the head of the drum and a second position in which the snares are moved away from the head of the drum. The snare strainer includes a handle pivotally mounted on the cylindrical tube which is connected to a cross member engaging the piston by a link. The link is pivotally connected at one end to the cross member and at its opposite end to a pivotal connection of said handle. The pivotal connections are positioned so that rotation of the handle to move the piston between the first and second positions of the piston moves the pivotal connection of the handle of the link and the pivotal connection of the link of the cross member through over center positions. The cylindrical tube is formed of a glass reinforced polycarbonate and the piston is formed of a nylon 66.

4 Claims, 2 Drawing Sheets

SNARE STRAINER FOR A DRUM

BACKGROUND AND SUMMARY OF THE INVENTION

This invention is directed to a snare strainer having many of its moving and guiding components formed, dimensioned and arranged to eliminate the undesirable features of conventional snare strainer mechanisms such as internal rattling, noise during release of tensioning or "throw-off" of the snares, incompatibility with drums of varying sizes and high cost of production.

An object of this invention is a snare strainer whose design and not necessarily the material of its construction provides the required structural and mechanical integrity.

Another object of this invention is a snare strainer which firmly guides the snares during both the application and release of tension on the snares.

Still another object of this invention is a snare strainer having operating component parts formed with large bearing surfaces to accurately guide the strainer during actuation.

An additional object of this invention is a snare strainer having a self-locking, fine tuning mechanism for tensioning the snares.

Yet another object of this invention is a snare strainer which is noiseless during both the application and the release of tension on the snares.

A further object of this invention is a snare strainer which is guided during the application of tension to and release of tension on the snares by movement of a relatively large diameter piston in a relatively thick walled tube.

Yet still another object of this invention is a snare strainer which is operated by a link in an over center lever mechanism to lock the strainer in its snare tensioning position.

A still further object of this invention is a snare strainer some of whose component parts are constructed of glass reinforced polycarbonate and others of nylon.

Other objects of the invention may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 1:
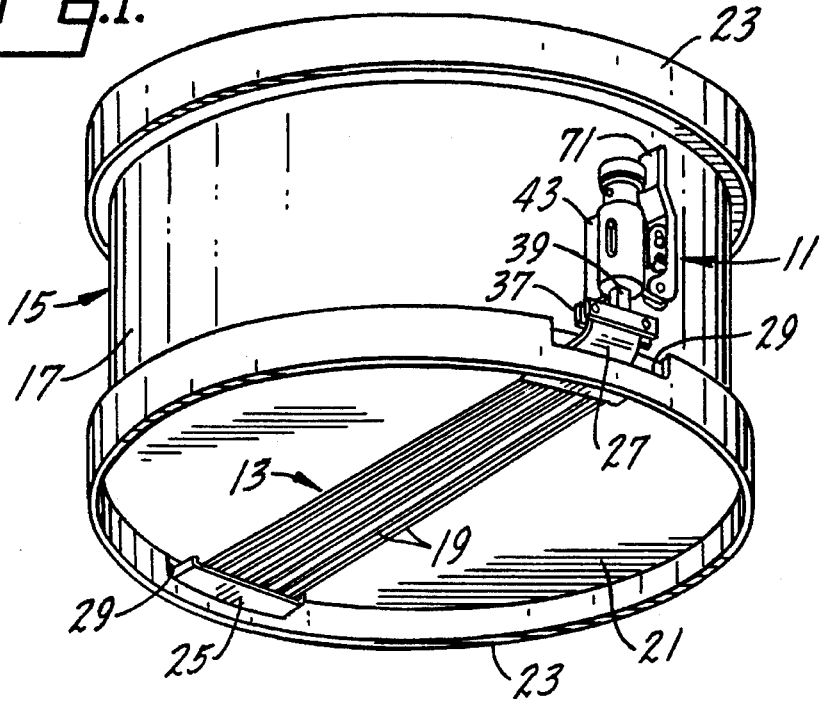
FIG. 1 is a bottom perspective view of a snare drum on which is mounted a snare strainer of this invention.

FIG. 1 of the drawings shows the snare strainer 11 of this invention attached to a snare unit 13 mounted on a drum 15. As is conventional, the drum 15 includes a shell 17 with the wires or snares 19 of the snare unit 13 positioned against the bottom drum head 21 of the drum. The drum heads are held in position against the shell 17 by rims 23.

The opposite ends of the snare wires 19 are held by a stationary snare anchor 25 and a shiftable snare anchor 27 which extend through notches 29 formed in the lower rim 23. The stationary snare anchor 25 is held by a cross member 31 to a bracket 33 which fastened to the shell 17 of the drum by fasteners 35. The shiftable snare anchor 27 connects to a T-shaped snare clamp 37 which is formed integrally with a snare tensioning rod 39 of rectangular cross section.

Figure 2:
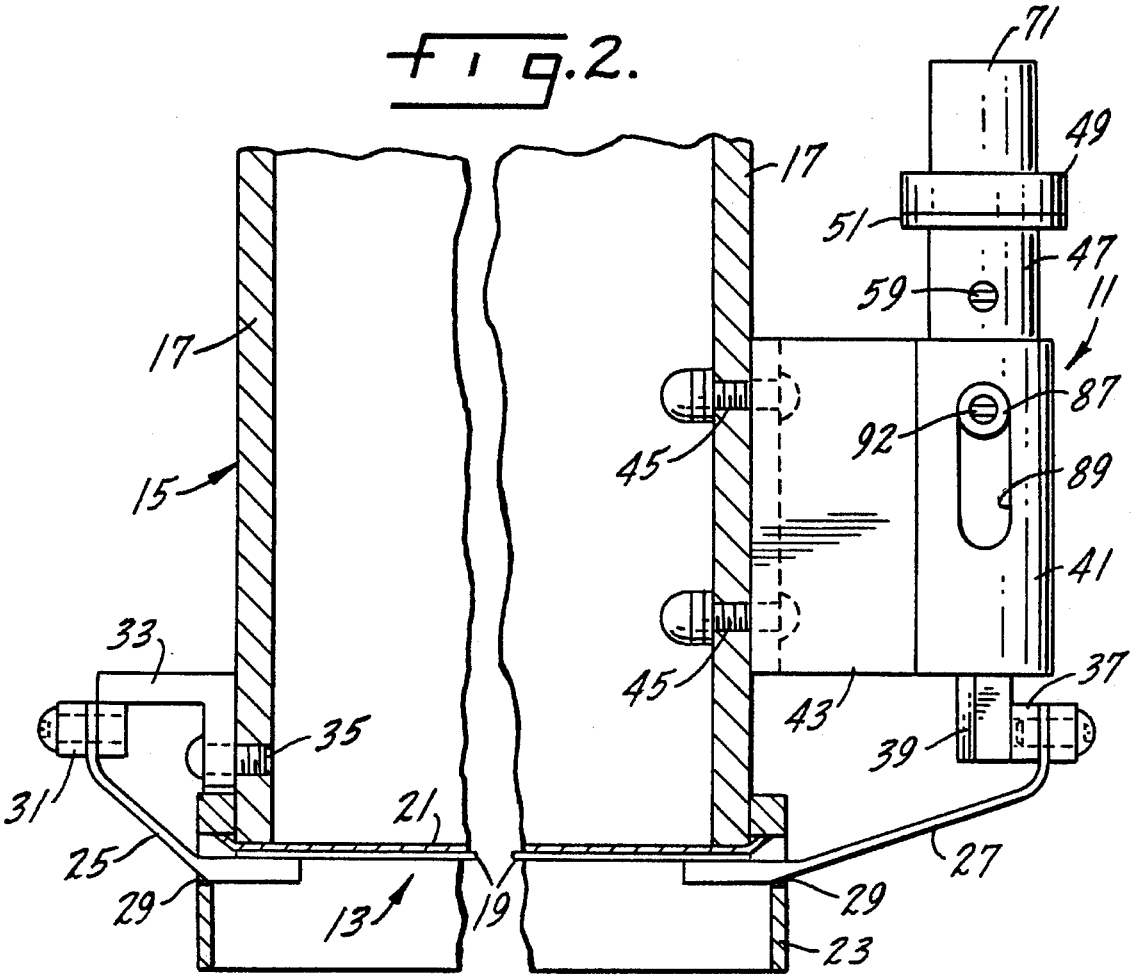
FIG. 2 is an enlarged, partial, broken, cross sectional view of a shell of a drum on which is mounted the snare strainer of this invention.

The snare strainer 11 includes a cylindrical tube 41 formed of a polycarbonate reinforced with 1–5% glass fibers which is sold under the trademark LEXAN 41 by the General Electric Company. The cylindrical tube 41 has an integral L-shaped bracket 43 by which it is mounted on the shell 17 of the drum by threaded fasteners 45 (FIG. 2). A cylindrical knob 47 telescopes into the cylindrical tube 41. The knob includes an integral head 49 of greater diameter. A rubber washer 51 encircles the knob at the base of the head and functions as a sound deadening cushion.

Figure 7:
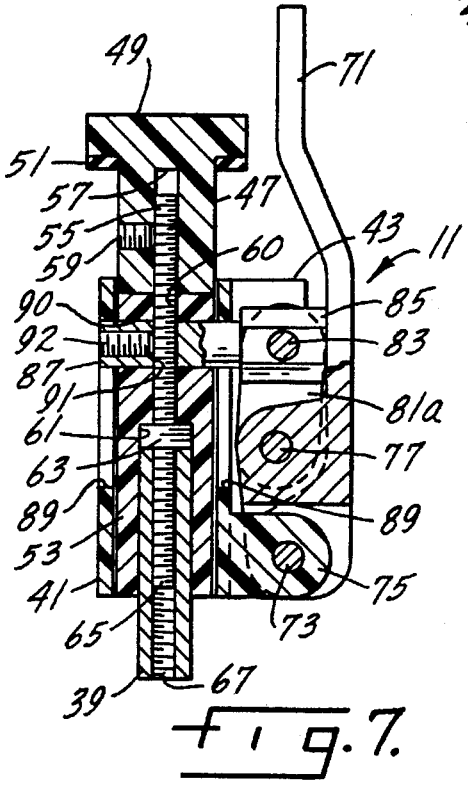
FIG. 7 is a cross sectional view taken along line 7—7 of FIG. 6.

A piston 53 is installed in the cylindrical tube 41 in engagement with the knob 47 as can be best seen in FIG. 7. The piston may be made of a plastic, preferably a nylon 66 sold under the trademark ZYTEL 100 by E. I. DuPont de Nemours & Co. As can also be seen in FIG. 7 of the drawings, a metal rod 55 is positioned in a bore 57 in the knob 47 and is held in position by a set screw 59. The rod extends out of the knob 47, through a bore 60 and into an enlarged bore 61, both in the piston. The rod 55 is provided with an enlarged head 63 intermediate its ends. The lower portion of the rod 55 is threaded at 65 to mesh with inside threads 67 of the snare tensioning rod 39.

An operating handle 71 for applying tension to and releasing tension from the snare bed 13 is pivotally mounted by a pivot pin 73 to a bracket 75 formed integrally with the cylindrical tube 41. Also carried on the handle 71 is a pivot pin 77 which is a part of a link assembly 81 attached to the handle. The link assembly 81 is preferably of the type used as a repair link for motorcycles and which is sold under the trademark "MASTERLINK". The link assembly 81 includes two spacer links **81*a*, one positioned on each side of the handle and a locking clip link 81*b* which holds the link assembly together. A pivot pin 83 fits in the opposite end of the link assembly and it is pivotally connected to the head 85 of a cross rod 87 which extends through a cross passage 89 in the cylindrical tube 41 and a cross passage 90 in the piston 53. The pivot pins 77 and 83 are positioned closer to the cylindrical tube 41 than is the pivot pin 73 when the handle 71 is moved to its tension applying position shown in FIGS. 3 and 7 of the drawings. In this position of the handle 71, the pivot pin 77 which connects the handle and the link assembly 81 is closest to the cylindrical tube 41 and thus is in an over center position relative to both the pivot pin 73 and the pivot pin 83. The over centering of the pivot pins 77 and 83 in the tensioning applying position of the operating handle 71** prevents accidental release of the handle.

The cross rod 87 has a transverse passage 91 which receives the rod 55. A set screw 92 of nylon fastens the cross rod 87 to the rod 55 by engaging the threads of the rod. The cross rod 87 locks the piston 53 in position relative to the rod 55. As best can be seen in FIGS. 2 and 7 of the drawings, the cross passage 89 in the cylindrical tube 41 is elongated and permits the cross rod 87 to be moved along the length of the cross passage 89 in the cylindrical tube 41 upon rotation of the handle 71.

Figure 3:
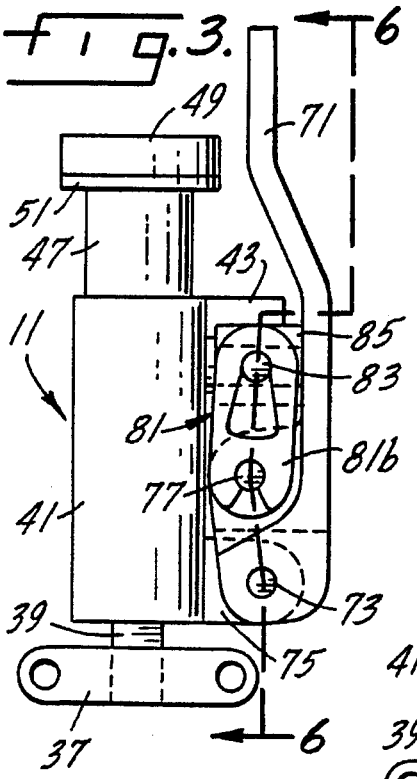
FIG. 3 is a side elevational view of the snare strainer of this invention in its snare tension applying position.
Figure 4:
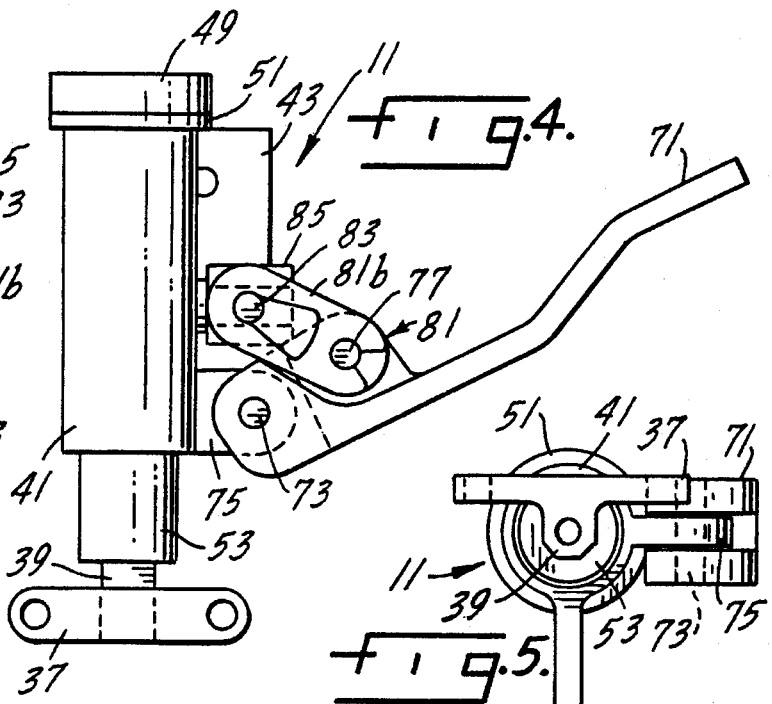
FIG. 4 is a view of the snare strainer of FIG. 3 shown in its snare tension released position.
Figure 5:
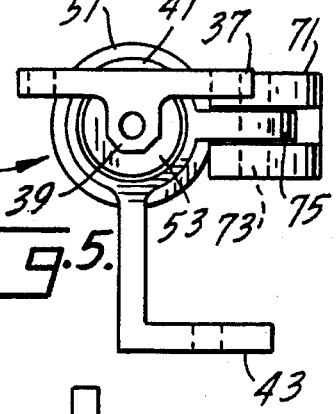
FIG. 5 is a bottom plan view of the snare strainer of FIG. 3.
Figure 6:
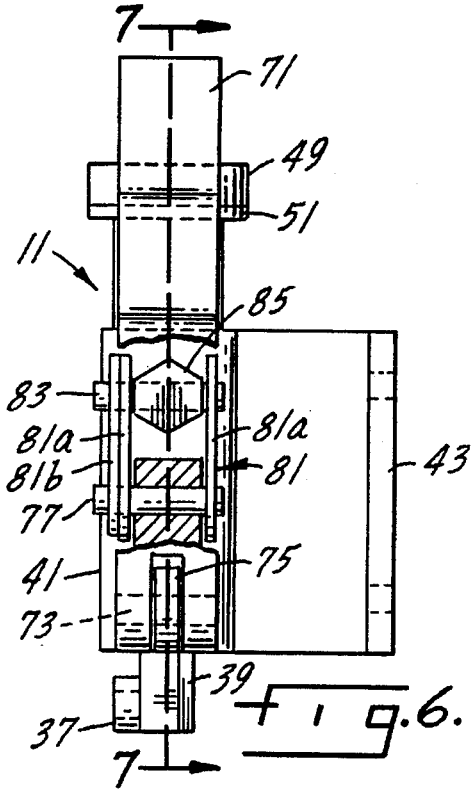
FIG. 6 is a view taken along line 6—6 of FIG. 3.

When the snare wires 19 are in contact with a drum head 21 as shown in FIGS. 1 and 2 of the drawings, the operating handle 71 is in its vertical position, as additionally shown in FIGS. 3, 6 and 7 of the drawings, with the cross rod 87 at the top of the elongated cross passage 89 of the cylindrical tube 41. With the handle in this upward position, the pivot pin 77 is located in an over center position relative to the pivot pins 73 and 83 of the operating mechanism. When the handle 71 is rotated in a clockwise direction as viewed in FIGS. 3, 4 and 7 of the drawings to move the snares 19 of the snare bed to their tension released position, the pivot pin 77 of the handle 71 is moved through an over center position relative to the pivot pin 73 and the pivot pin 83 to move the cross rod 87 downwardly along the length of the cross passage 89. The piston 53 is forced downwardly by the cross rod 87 to move the snare tensioning rod 39, the snare anchor 27 and the snares 19 in a downwardly direction as viewed in FIGS. 1 and 2 of the drawings. When the handle reaches its lowered position as shown in FIG. 4 of the drawings, the washer 51 prevents the head 49 of the knob 47 from engaging the top of the cylindrical tube 41 and making a sound.

The tension on the snare wires 19 of the snare bed 13 can be adjusted by rotating the knob 47 relative to the cylindrical tube 41. Because of the tight fitting relationship between the set screw 92 and the threaded rod 55, the tensioning rod 39 and the knob will lock in position after tensioning adjustments. Rotation of the knob 47 will rotate the threads at the end 65 of the rod 55 relative to the inside threads 67 of the snare tensioning rod 39 to accurately move the snare tensioning rod and snare anchor 27 and, thus, adjust the tension of the snares 19 on the snare bed 13.

The design of the sliding piston 53 in the cylindrical tube 41 provides relatively large bearing surfaces for the moving parts of the snare strainer 11. These large bearing surfaces permit the snare strainer to be constructed for the most part of plastic without sacrificing its structural integrity. The use of plastic provides the advantages heretofore described as well as economies of manufacture.

I claim:

1. A snare strainer for a snare drum having snares and a shell, said snare strainer including:

a cylindrical tube, means to mount said cylindrical tube to the shell of the drum, a piston installed in said cylindrical tube for slidable movement between a first position and a second position, a snare tensioning rod affixed to said piston and said snares to locate said snares against said drum when said piston is in said first position and to locate said snares away from said drum when said piston is in said second position, a quick release mechanism mounted on said cylindrical tube and connected to said piston for moving said piston between said first and second positions, said quick release mechanism including a handle pivotally mounted on said cylindrical tube, a cross member engaging said piston, and an elongated closed loop link pivotally connected at one end to said cross member and at an opposite end to said handle so that the rotation of said handle will rotate said pivotal connections of said link to an over center position during movement of said piston between said first and second positions.

2. The snare strainer of claim 1 including a knob installed in said cylindrical tube in contact with said piston, and means connecting said knob to said snare tensioning rod to slide said knob and said snare tensioning rod relative to each other upon rotation of said knob.

3. The snare strainer of claim 1 in which said cylindrical tube is formed with a relatively thick wall and said piston is formed with a relatively large diameter providing large bearing surfaces to accurately guide said snare strainer during actuation.

4. The snare strainer of claim 3 in which said cylindrical tube is formed of a glass reinforced polycarbonate and said piston is formed of a nylon which is compatible with said glass reinforced polycarbonate.

* * * * *